US006132596A

United States Patent [19]

Yu

[11] Patent Number: 6,132,596

[45] **Date of Patent: *Oct. 17, 2000**

[54] PROCESS AND APPARATUS FOR THE TREATMENT OF WASTE OILS

[76] Inventor: Heshui Yu, 140 Carlton Street, Suite 905, Toronto, Ontario, Canada, M5A 3W7

[ * ] Notice: This patent issued on a continued prosecution application filed under 37 CFR 1.53(d), and is subject to the twenty year patent term provisions of 35 U.S.C. 154(a)(2).

[21] Appl. No.: 09/117,117

[22] PCT Filed: Jan. 24, 1997

[86] PCT No.: PCT/CA97/00053

§ 371 Date: Jul. 22, 1998

§ 102(e) Date: Jul. 22, 1998

[87] PCT Pub. No.: WO97/27273

PCT Pub. Date: Jul. 31, 1997

[51] Int. Cl.[7] ..... C10M 175/00; C10G 9/36; C10G 9/14

[52] U.S. Cl. ..... 208/179; 208/67; 208/130; 208/132

[58] Field of Search ..... 208/67, 130, 132, 208/179; 422/198, 200, 201

[56] References Cited

U.S. PATENT DOCUMENTS

| | | | |
|---|---|---|---|
| 3,580,838 | 5/1971 | Lutz | 208/100 |
| 3,954,602 | 5/1976 | Troesch et al. | 208/179 |
| 3,991,816 | 11/1976 | Klaren | 165/1 |
| 4,242,196 | 12/1980 | Aiba et al. | 208/40 |
| 4,894,140 | 1/1990 | Schön | 208/72 |
| 5,049,258 | 9/1991 | Keim et al. | 208/184 |
| 5,143,597 | 9/1992 | Sparks et al. | 208/131 |
| 5,258,115 | 11/1993 | Heck et al. | 208/131 |
| 5,271,808 | 12/1993 | Shurtleff | 196/46 |
| 5,286,349 | 2/1994 | Shurtleff | 196/46 |
| 5,362,381 | 11/1994 | Brown et al. | 208/179 |

FOREIGN PATENT DOCUMENTS

| | | |
|---|---|---|
| 341717 | 5/1934 | Canada . |
| 471739 | 10/1945 | Canada . |
| 2001966 | 1/1991 | Canada . |
| 0308669 | 3/1989 | European Pat. Off. . |
| 3224114 | 12/1983 | Germany . |

OTHER PUBLICATIONS

Patent Abstracts of Japan for JP 56082886.

*Primary Examiner*—Walter D. Griffin
*Assistant Examiner*—Tam M. Nguyen
*Attorney, Agent, or Firm*—Baker Botts L.L.P.

[57] ABSTRACT

The present invention is directed to a process and apparatus for the reclaiming and re-refining of waste oils. The process comprises raising a temperature of a feed mixture of fresh waste oil and a recycled non-volatile residue to a range of 400° C. to 490° C. for a time sufficient to cause pyrolysis of said heavy hydrocarbons contained in the feed mixture, but insufficient to permit substantial undesired polymerization, oxidation and dehydrogenation reactions to take place in said feed mixture; cooling the resulting pyrolyzed waste oil mixture to a temperature in the range of 300° C. to 425° C., and maintaining said temperature while allowing volatile components in the pyrolyzed waste oil mixture to evaporate, leaving a non-volatile residue containing said contaminants; condensing the evaporated volatile components to form a reclaimed oil product; and mixing the non-volatile residue with fresh waste oil to form more of said feed mixture and repeating said temperature raising, cooling, evaporation and mixing steps on a continuous basis, while continuing to condense volatile components evaporated from said pyrolyzed waste oil mixture. The apparatus comprises a heating unit, a container, a condenser and pumping equipment and piping. The process and apparatus of the present invention generate #2 diesel fuel, gasoline and coke from waste oil.

7 Claims, 5 Drawing Sheets

PROCESS AND APPARATUS FOR THE TREATMENT OF WASTE OILS

TECHNICAL FIELD

This invention relates to a process and apparatus for reclaiming waste oils from various sources.

BACKGROUND ART

Used oil represents a major environmental problem. For example, in 1992, the U.S. Environmental Protection Agency estimated that of the 4.9 million cubic meters (1.3 billion gallons) of used oil produced annually in the United States, only about 2% was being re-refined, despite the existence of a large number of physical and chemical processes developed for reclaiming or re-refining industrial and automotive lubricants. The remainder of the waste oil, presumably, was being dumped or discarded into the environment in various ways.

An early major treatment process involved re-refining waste oil with sulfuric acid and clay. Sulfuric acid acts as an extraction medium for the removal of unsaturates, dirt, additives and colored materials from the waste oil. The clay is used as an adsorbent to remove impurities. Disadvantageously, in this process, large quantities of spent acid sludge and clay are produced and must be disposed of as a process waste.

In order to avoid the waste disposal problems from acid-clay processes, different types of distillation processes have been developed, for example, as disclosed in U.S. Pat. No. 3,625,881 and U.S. Pat. No. 4,071,438. These processes produce a recycled lubricant as a major product and a carbon-black slurry as a process waste.

Recently, the development of a process for reclaiming useful fuel has resulted in the production of diesel fuel from waste oil, as disclosed, for example, in U.S. Pat. Nos. 5,271,808 and 5,286,349. U.S. Pat. No. 5,271,808 discloses a process for reclaiming waste oil wherein a vessel heater is used. In this process, because a large volume of feedstock is held in a heater vessel under high temperature for a long residence time, undesired polymerization, oxidation and dehydrogenation take place, resulting in the production of an unstable diesel fuel and a large volume of ash cake residue. Additionally, the run length of the process is quite short.

DE-A-3,224,114 discloses a process and apparatus for cracking used motor vehicle engine oil by heating with microwaves. The used oil cracks on heating to the distillation point. The volatile products are removed in a condenser.

JP-56 082886 discloses a process to suppress local coking and to improve the yield of light oil, by mixing a catalyst with a heavy oil to form a uniform slurry. The slurry is cracked in the liquid phase catalytically.

EP-0 308669 discloses processing materials containing halogenated hydrocarbons by pyrolysis in a fluidised bed of basic substance.

U.S. Pat. No. 5,143,597 describes a used lubricant oil recycling process in which a used lubricating oil is injected to a delayed coker downstream of the coker furnace whereby the used oil is thermally cracked into hydrocarbon fuel products.

SUMMARY OF THE INVENTION

An object of the present invention is to overcome some or all of the disadvantages of prior waste oil reclaiming techniques by providing an effective, low cost process and apparatus for reclaiming waste oil.

Another object of the present invention, at least in its preferred forms, is to provide a process for reclaiming waste oil that results in the production of an acceptably stable and valuable #2 diesel fuel or gasoline.

Still another object of the invention is to provide a process for reclaiming waste oil that results in the formation of less residue than any prior process while enabling longer run times between shutdowns.

It is a further object of this invention to provide a pyrolysis unit and a cylindrical reactor for use in the process of the invention.

According to one aspect of the present invention, there is provided a process of treating waste oil containing heavy hydrocarbons and contaminants. The process comprises raising the temperature of a feed mixture of fresh waste oil and a recycled non-volatile residue to a range of 400° C. to 490° C. (measured at the output of the heating unit) for a time sufficient to cause pyrolysis of the heavy hydrocarbons contained in the feed mixture, but insufficient to permit substantial undesired polymerization, oxidation and dehydrogenation reactions to take place in the feed mixture. The resulting pyrolyzed waste oil mixture is then cooled to a temperature in the range of 300° C. to 455° C., preferably 300° C. to 425° C. and most preferably 300° C. to 375° C., and maintained at this temperature while allowing volatile components in the pyrolyzed waste oil mixture to evaporate, leaving a non-volatile residue containing the contaminants. The evaporated volatile components are condensed to form a reclaimed oil product, and the non-volatile residue is mixed with fresh waste oil to form more of the feed mixture. The steps of raising the temperature, cooling, evaporation and mixing are then repeated on a continuous basis, while volatile components evaporated from the pyrolyzed waste oil mixture continue to be condensed.

The process temperature to which the waste oil is heated for pyrolyzation depends on the designed conversion. That is to say, higher temperatures will be used for higher percentage gasoline yields, and lower temperatures for higher percentage diesel oil yields.

In a preferred form of the process, when the yield of the reclaimed oil product falls below a predetermined level, the temperature of the feed mixture is raised above the range of 400° C. to 490° C. to promote "deep cracking" of the heavy hydrocarbons, and a resulting pyrolyzed waste oil mixture is then subjected to further cooling, evaporation and mixing steps.

In yet another preferred form of the process, when contaminants in the pyrolyzed waste oil mixture increase to a predetermined level, the non-volatile residue containing the contaminants is heated to a temperature in the range of 470° C. to 590° C. for a short time, and is then brought to a temperature in the range of 440° C. to 570° C. and is maintained at that temperature under a pressure of 21 kPa to 172 kPa (3 to 25 p.s.i.g.) to cause the residue to undergo a further pyrolysis and a coking reaction, creating further volatile components and a solid coke, whereupon the further volatile components are removed and condensed, and the solid coke is collected and discarded.

In still another preferred form of the process, the feed material is mixed with steam before being raised in temperature.

According to another aspect of the invention, there is provided an apparatus for treating waste oil containing heavy hydrocarbons and contaminants. The apparatus comprises a heating unit for raising a temperature of a feed mixture of fresh waste oil and a recycled non-volatile residue to a range of 400° C. to 490° C. for a time sufficient to cause pyrolysis of the heavy hydrocarbons contained in the feed mixture, depending on the designed conversion of the cylindrical reactor, but insufficient to permit substantial undesired polymerization, oxidation and dehydrogenation reactions to take place in the feed mixture; a container for receiving the resulting pyrolyzed waste oil mixture and for holding and maintaining the pyrolyzed waste oil mixture at a temperature in the range of 300° C. to 455° C., preferably 300° C. to 425° C., most preferably 300° C. to 375° C., while allowing volatile components in the pyrolyzed waste oil mixture to evaporate, leaving a non-volatile residue containing the contaminants; a condenser for condensing the evaporated volatile components to form a reclaimed oil product; and pumping equipment and piping for mixing the non-volatile residue from said container with fresh waste oil to form more of said feed mixture, for continuously recirculating said feed mixture through said heating unit to said container, and for conveying said volatile components from said container to said condenser.

The heating of the feed material is preferably carried out in a tubular heating unit capable of operating at a high liquid velocity (e.g. a velocity in the range of about 0.6 m to 4.5 m/s (2 to 15 feet/second, and more preferably 1.2 m to 3.0 m/s (4 to 10 feet/second)), and the pyrolyzed mixture is preferably cooled and the volatile components evaporated in a preferably cylindrical reactor acting as the container mentioned above. The temperature of the cylindrical reactor is controlled by adjusting the volume of preheated feedstock introduced into the cylindrical reactor. Due to a short residence time in the tubular heating unit (i.e. 1 to 30 seconds, preferably 1 to 15 seconds and most preferably 3 to 10 seconds), and relatively low temperatures in the cylindrical reactor, undesired side reactions are minimized.

Under the high temperatures present in the tubular heating unit, all of the metal constituents and other contaminants of the waste oil are decomposed to metals, hydrocarbons and heavy residues. The light fuel vapors with any accompanying steam emanating from the cylindrical reactor are preferably introduced into a heat exchanger to preheat the fresh waste oil feedstock (e.g. to a temperature in the range of 110° C. to 150° C.). The remainder heavier oil in the cylindrical reactor with fresh waste oil feedstock is pumped into the tubular heating unit again for a second heating and pyrolysis reaction, and this procedure is repeated continuously. When high boiling point oil in the cylindrical reactor accumulates to such an extent that process production decreases, the temperature in the tubular heater is increased for deep cracking. After that, the temperature is returned to normal.

As an option, steam injection into the tubular heater for steam cracking can be used. This improves oil stability and decreases coke formation. The steam may be produced by the tubular heating unit.

The preheated feedstock is normally introduced into the upper part of the cylindrical reactor and is sprayed downwardly at the center. The heated pyrolyzed mixture from the heated tubes in the tubular heating unit is introduced near the bottom of the cylindrical reactor. The feedstock lines for the heating tubes are introduced from the bottom of the cylindrical reactor, then pass a pump into the tubular heater. The feedstock from the cylindrical reactor can enter the tubular heater from either the top or the bottom. If desired, the preheated feedstock can be pumped directly to the tubular heater without passing through, or only partially passing through, the cylindrical reactor depending on the temperature of the fluid within the cylindrical reactor.

The products generated from reclaiming waste oil using the process and apparatus of the present invention include #2 diesel fuel, gasoline and coke. The process and apparatus can be operated without causing significant waste disposal problems.

The process feedstock can be any type of waste oil, such as motor oil, industrial lubricants, vegetable oil, fish oil, industrial oil sludge and spilled waste crude oil.

BEST MODES FOR CARRYING OUT THE INVENTION

Figure 1:
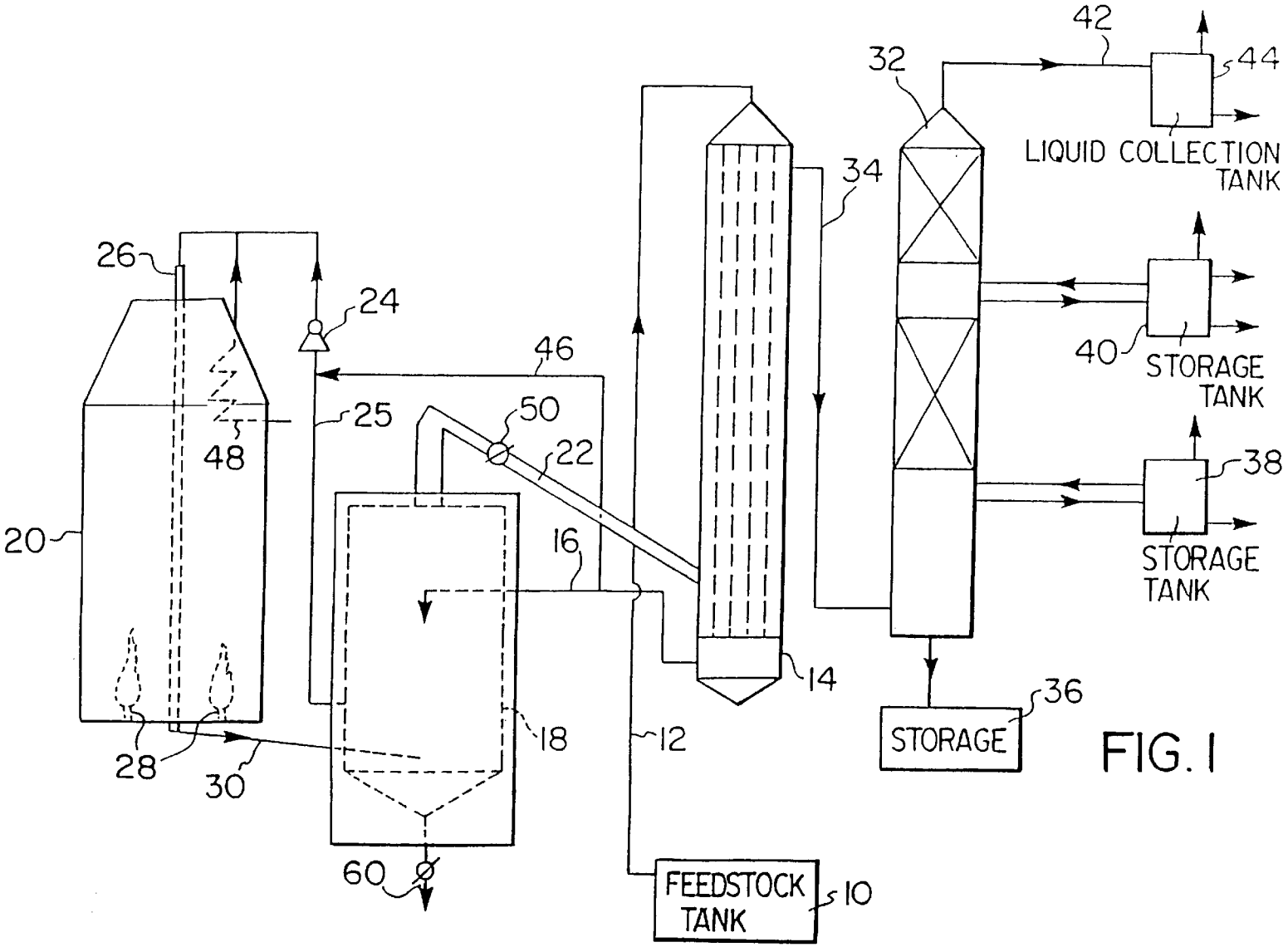
FIG. 1 is a schematic view of an example of apparatus that may be used to operate the process of the present invention.

An example of the overall process of the invention, and typical apparatus used therefor, is illustrated with reference to FIG. 1. In the illustrated process, fresh waste oil, the process feedstock, is fed by suitable pumping equipment (not shown) from feedstock tank 10 via pipe 12 to the top of a heat exchange column 14 (more than one such column may be provided, if required), where it flows downwardly and is pre-heated (generally to a temperature in the range of 110° C. to 150° C.) by heat exchange with product vapor (derived in a manner to be described later). The preheated feedstock is then pumped from the bottom of the heat exchange column 14 via line 16 into a cylindrical reactor 18 which forms a container for receiving and holding a pyrolyzed waste oil mixture from a tubular heating unit 20. The pyrolyzed mixture is held within the reactor 18 at a predetermined temperature within the range of 300° C. to 455° C., preferably 300° C. to 425° C., most preferably 300° C., to 375° C., while volatile components are evaporated therefrom, as will be described more fully later. The preheated waste oil from line 16 is sprayed downwardly into the pyrolyzed waste oil mixture held at the bottom of the cylindrical reactor 18 to create a mixture of the fresh preheated waste oil and the pyrolyzed waste oil mixture for further treatment. The spraying of the fresh waste oil also has the effect of cooling the pyrolyzed waste oil mixture to the desired temperature range of 300° C. to 455° C. Light oil and water from the fresh preheated waste oil and from the pyrolyzed waste oil mixture are evaporated and distilled off, leaving a non-volatile residue, and the resulting vapor is removed from the cylindrical container 18 via pipe 22 leading to the heat exchange column 14.

The mixture of fresh waste oil and the non-volatile residue of the pyrolyzed waste oil mixture formed in the cylindrical reactor 18 in the manner stated, is pumped by pump 24 as a feed mixture via pipe 25 to a series of heating tubes 26 (only one of which is shown in FIG. 1, but see FIG. 2) within the tubular heating unit 20. The unit 20 acts as an apparatus for rapidly raising the temperature of the feed mixture to a desired range of 400° C. to 490° C. for a short period of time (usually 1 to 30 seconds, preferably 1 to 15 seconds and most preferably 3 to 10 seconds). Heat is created within the unit 20 by means of burners 28, turning the interior of the unit into a fire chamber. The burners may burn a conventional fuel or a fuel or a gas from the reclamation process itself.

The feed mixture passing through the tubes 26 is heated rapidly by virtue of the large surface area of the tubes and the relatively small volume of feed mixture within the tubes. The tubes 26 are preferably straight, with a length of preferably from 1.8 m to 6.0 m (6 to 20 feet), although the number and length of heating tubes depends on the per day volume of feedstock to be processed and the velocity of the feed mixture through the tubes (preferably 0.6 m to 4.5 m/s (2 to 15 feet/second), and ideally 1.2 m to 3.0 m/s (4 to 10 feet/second)). The heating tubes 26 could be coils. As the temperature difference between the contents of the tubular heating unit 20 and the contents of the cylindrical reactor 18 is only about 100° C., the heat consumption in the tubular heating unit is normally quite low, thus minimizing the size of the tubular heating unit 20. The diameter of the heating tubes 26 is most preferably in the range of 1.25 cm–12.5 cm (0.5–5 inches) for efficient heating of the feed mixture within the heating tubes.

As already noted, the feed mixture is heated to the desired temperature of 400° C. to 490° C. in the tubes 26 for a period of time sufficient to cause pyrolysis of heavy hydrocarbons in the feed mixture, but insufficient to permit substantial undesired polymerization, oxidation and dehydrogenation reactions to take place. This time period depends to a certain extent on the type of feed mixture, but is generally in the range of 1 to 30 seconds, preferably 1 to 15 seconds and most preferably 3 to 10 seconds.

The resulting hot streams of pyrolyzed waste oil mixture from tubes 26 are passed to the bottom of the cylindrical reactor 18 via a pipe 30. The temperature of the fluid in the cylindrical reactor 18 decreases from bottom to top due to an endothermic pyrolysis reaction that continues to take place in the reactor 18 and due to cooling caused by the spray of fresh waste oil feedstock from pipe 16. The volatile oil and water components from the reactor 18, on being removed from the reactor through pipe 22, are first passed upwardly through heat exchange column 14 to pre-heat the fresh waste oil feedstock, as already described, and are then fed to a distillation column 32 via pipe 34 to form reclaimed oil fractions, the desired product, and water that may be re-used, as will be described later.

In the apparatus as shown in FIG. 1, three fractions are obtained from distillation column 32 and are transferred to tanks 36, 38 and 40. Remaining gas and light ends are discharged through pipe 42 and condensed in liquid collection tank 44. The most desired product, #2 diesel fuel (usually condensing at 110° C.–360° C.), is generally collected in tank 38, light fuel (usually condensing at 75° C.–150° C.) and water are collected in tank 40 and heating fuel (condensing at temperatures greater than 360° C.) is collected in tank 36.

As an alternative to the procedure indicated above, it is possible, for example when the pyrolyzed waste oil mixture in cylindrical reactor 18 requires no further cooling, to divert the preheated fresh waste oil feedstock issuing from heat exchange column 14 completely or partially from the cylindrical reactor 18 to the inlet of the tubular heating unit 20 via pipe 46. The fresh waste oil feedstock then mixes directly with the non-volatile residue of the pyrolyzed waste oil mixture from reactor 18 within pump 24 before the resulting feed mixture enters the tubes 26.

As a further alternative, the feed mixture being delivered to the heating unit 20 from the cylindrical reactor 18 is admixed with steam from a steam heater 48, in amounts ranging from 3 to 50 mole percent, preferably 10 to 50 mole percent, steam, prior to entry of the feed mixture into the heating tubes 26. The steam heater 48 is a tube coil or a steam boiler which may be set in the upper portion of the tubular heater 20. The mixed stream is heated in heating tubes 26 and enters cylindrical reactor 18, as before. The added steam, in conjunction with light fuel vapor, passes through the heat exchanger 14 via pipe 22, is then separated in distillation column 32 into storage tank 40. The hot water in tank 40 may then be pumped to steam heater 48 for re-use.

During the process of the invention, it is usual to provide a pressure of 276 kPa to 1034 kPa (40 to 150 p.s.i.g.) within the heating tubes 26. The pressure can be controlled by suitable adjustment of a valve (not shown) in the tubular heater outlet line 30.

The amount of fresh waste oil added from tank 10 may be balanced with the amount of product produced by the system so that the process may be operated on a continuous basis indefinitely. However, after a period of operation, it is generally found that the yield of the desired reclaimed oil product declines as the content of contaminants increases within the recirculating pyrolyzed mixture. For example, the yield may decline to 75% of the desired yield. When this occurs, it has been found that the temperature of the fluid within the tubular heating unit 20 may be raised to the range of 460° C. to 520° C., to effect "deep pyrolysis" of the heavy hydrocarbons within the fluid, i.e. a greater degree of hydrocarbon cracking than is normally achieved. While this also risks undesired polymerization reactions and the like, it substantially increases the amount of volatile components available for distillation from the reactor 18, and thus improves the yield. The flow of fluid through the tubes 26 during this step is kept generally the same as during the regular part of the process and so the residence time within the tubes at the stated high temperature is about 1 to 15 seconds. The time required for the deep pyrolysis step, and the improvement in yield thereby obtained, are very much dependent on the nature of the feedstock, e.g. the content of sludge and other contaminants.

According to an important feature of the invention, after the process has run continuously for a long time (i.e. 1 to 6 months, depending on the nature of the waste oil), the heavy residue and sludge in the cylindrical reactor, which contains metals from waste oil additives and dirt, accumulates to an unacceptable level and a coking process must be carried out. To effect the coking process, the residue is heated in tubes 26 or a separate set of coking tubes (not shown) to a temperature in the range of 470° C. to 590° C. measured at the outlet of the tubes. The heated stream is fed back into the cylindrical reactor where it undergoes a pyrolysis reaction with the help of its entrained heat, under pressure of 21 kPa to 172 kPa (3 to 25 p.s.i.g.) and at a temperature of 440° C. to 570° C., the pressure being controlled by means of a control valve 50. The oil vapors produced thereby are distilled off in the normal way to form the desired product, and the coke containing metals and the like is deposited in the cylindrical reactor. After the coke has been formed, the system is shut down for decoking. The ultimate residue of the process of the invention is therefore a coke in relatively small amounts that can be disposed of using conventional means to avoid environmental pollution, or can be used as an industrial fuel.

Figure 2:
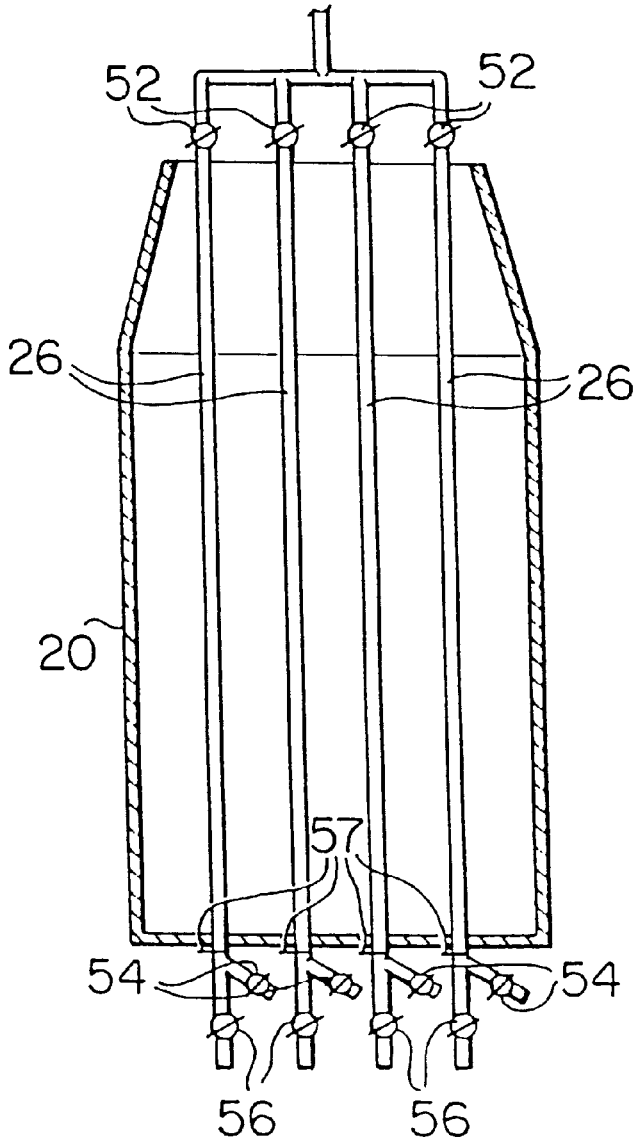
FIG. 2 is a schematic representation of a preferred tubular heater used in the apparatus of FIG. 1.

Referring to FIG. 2, this shows in more detail a preferred form of the tubular heating unit 20. As can be seen, the heating tubes 26 are straight and contain no coils. When steam is used, coiled tubes could alternatively be provided in order to increase the residence time of the heavier feedstock. The tubes may be set vertically, obliquely or horizontally. The hot feedstock and steam (when steam is used) enter the heating tubes 26 via valves 52, then leave via valves 54 for the cylindrical reactor 18. Plugs 56 at the bottom of each reaction tube are used for decoking and cleaning.

The temperature of the pyrolyzed mixture leaving the tubular heating unit 20 may be measured by temperature measuring devices 57, e.g. remotely monitored thermocouples.

Each reaction tube can be isolated by the indicated valves, so that failure of one tube does not affect the operation of the entire system and it can be replaced while the system continues to operate. As indicated above, a different set of coking tubes (not shown) may be provided, if desired, for the coking reaction in order to avoid undue deposition within the heating tubes 26. Such tubes would be much the same as tubes 26, but would have diameters in the range of 5 cm to 12.5 cm (2 to 5 inches), and would be arranged within the heating unit 20 parallel to tubes 26, but would only be fed with fluid when required for coking by the operation of appropriate valves (not shown). However, the reaction tubes 26 may themselves be used for the coking reaction since coke deposition is kept to a minimum by using high liquid velocities (e.g. from 0.6 m to 4.5 m/s (2 to 15 feet/second)), straight heating tubes and, optionally, steam injection, as already indicated.

Figure 3:
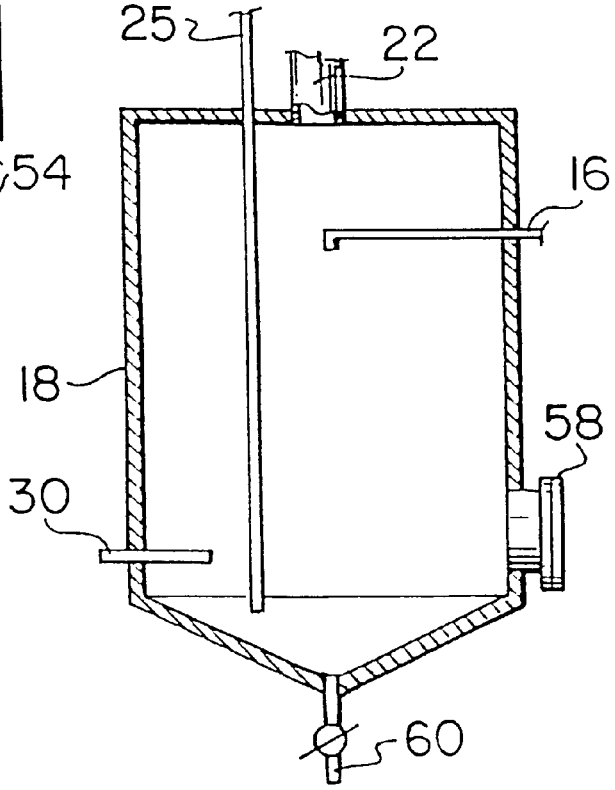
FIG. 3 is a schematic representation of a preferred cylindrical reactor used in the apparatus of FIG. 1.
Figure 6:
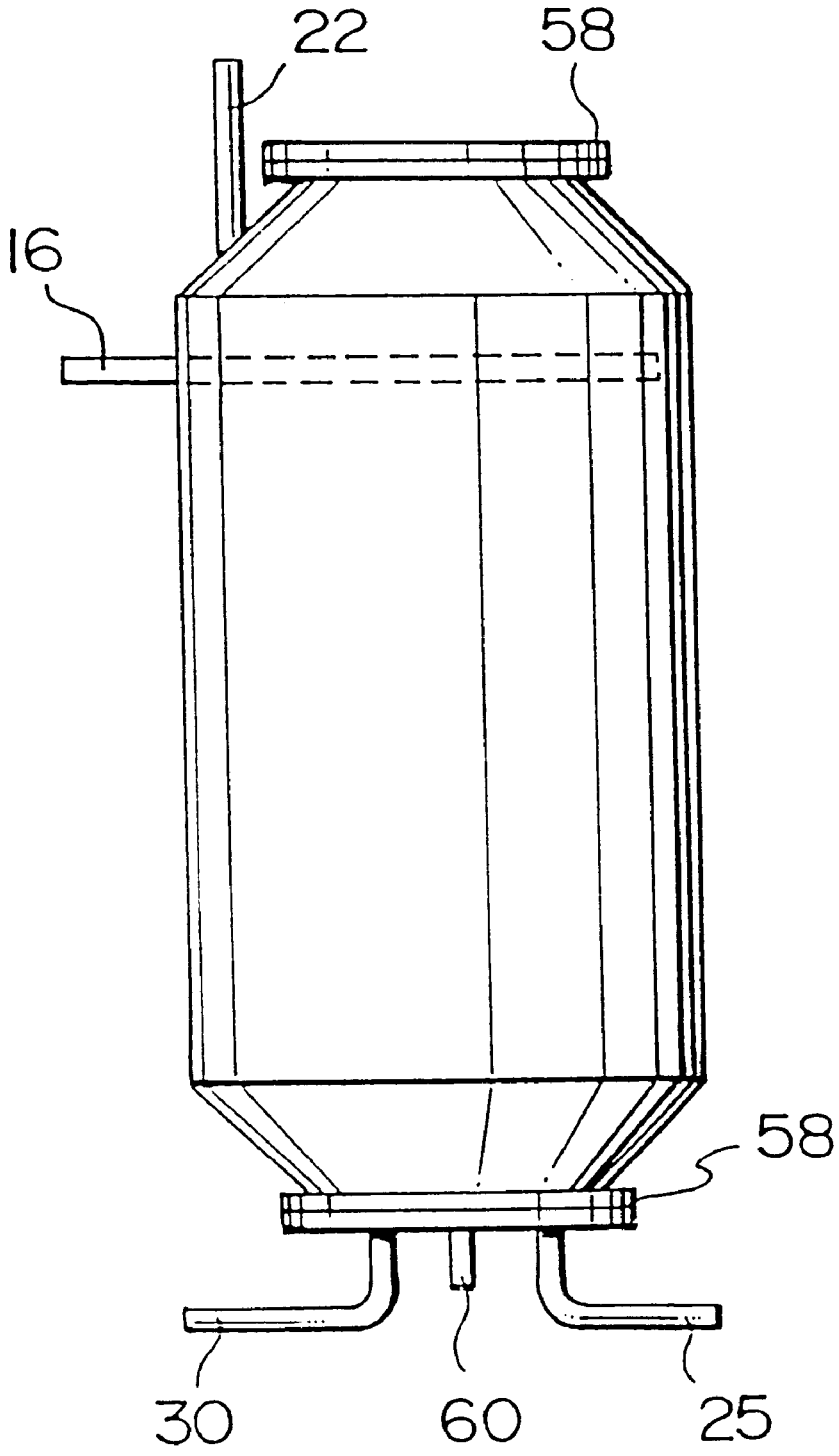
FIG. 6 is a schematic representation of an alternative cylindrical reactor.

FIG. 3 shows in more detail a preferred embodiment of the cylindrical reactor 18. FIG. 6 shows an alternative cylindrical reactor. In each the pipe 16 introduces preheated feedstock into the cylindrical reactor 18 and the pipe 25 is a line for delivering mixture to the tubular heating unit 20. In fact, the pipe 25 may be a series of tubes with inlets at different levels within the cylindrical reactor. The heated fluid from the heating tubes 26 is recirculated to the cylindrical reactor 18 by pipe 30, which can be one tube or a number of tubes depending on the size of the tubular heating unit 20. Oil and steam vapors are transferred to the heat exchange column 14 by tube 22, which is located at the top of the cylindrical reactor 18. A flange 58 is provided for coke cleaning, and a line 60 is for sampling. The reactor is made cylindrical for economy and for better containment of the usual reaction pressures, however, other shapes could be provided, if required. The top and bottom of the cylindrical reactor may be flat or cone-shaped, as desired.

During normal use, the coke formation in the cylindrical reactor 18 is limited by the high turbulence of the fluid within the reactor caused by the entrance of the high velocity oil and steam from the tubular heating unit 20, as well as the low reaction temperature of the cylindrical reactor where it is below 455° C. Therefore long run lengths can be achieved in this process. Decoking is normally required after the coking process has been carried out, and this may be achieved by steam decoking, water decoking, mechanical decoking or other methods.

Figure 4:
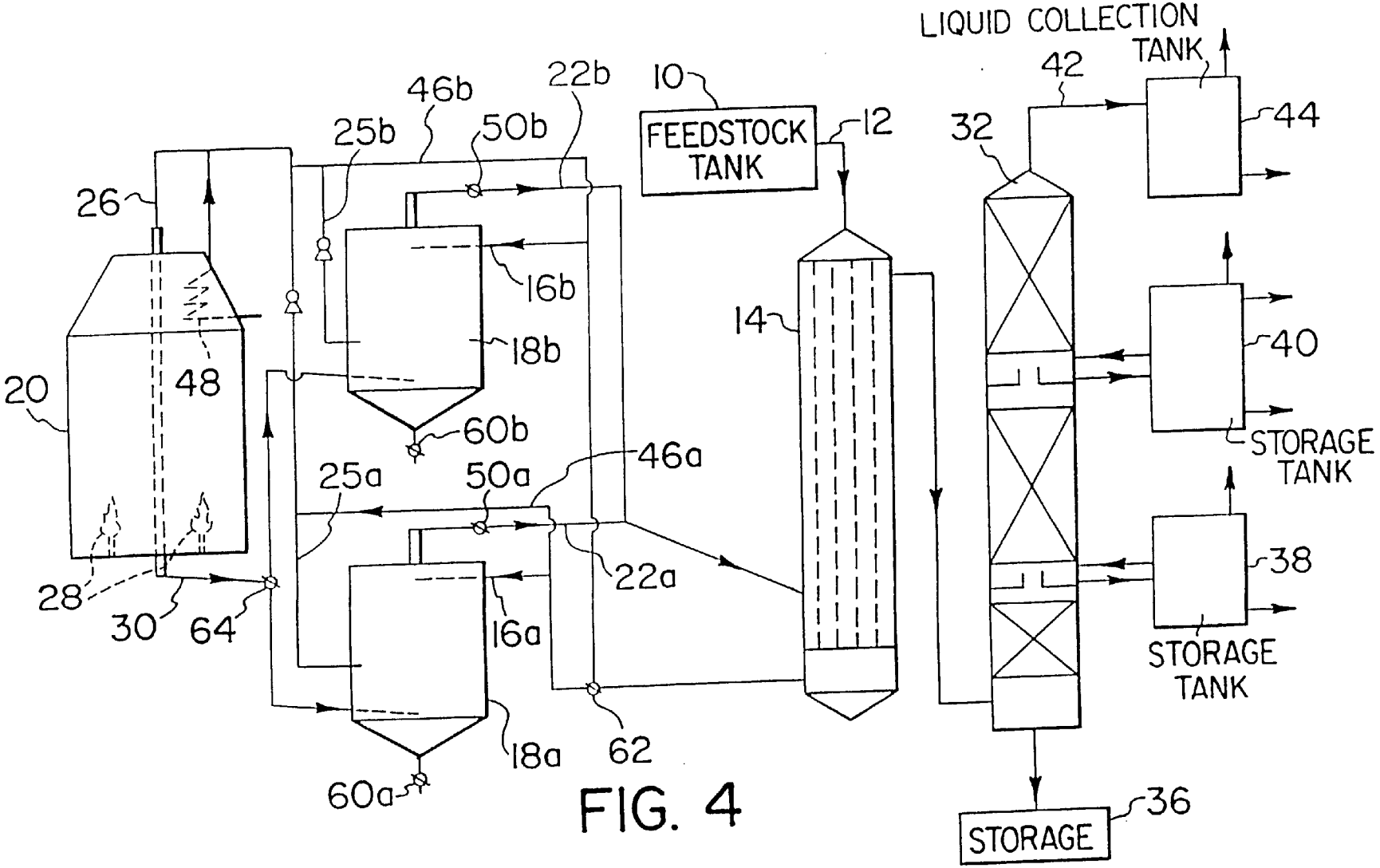
FIG. 4 is a schematic representation of an example of an apparatus having two cylindrical reactors.

For continuous operation without having to shut down the system for decoking, another cylindrical reactor can be provided to continue the reaction while the first reactor is being decoked and cleaned. The two cylindrical reactors will have the essentially same structure. FIG. 4 shows in more detail a preferred embodiment of an apparatus having two cylindrical reactors 18*a* and 18*b*. When one cylindrical reactor 18*a* is undergoing the decoking process, the feedstock from the heat exchanger 14 and heated effluent from the tubular heating unit 20 can be switched to the other cylindrical reactor 18*b* by valves 62 and 64. The apparatus of FIG. 4 is otherwise the same as that of FIG. 1.

As an alternative, when one cylindrical reactor 18*a* has been used for a time for the process of the invention, the heavy residue and sludge in the cylindrical reactor 18*a* can be pumped to the tubular heating unit 20 and heated to a heater outlet temperature of 470° C. to 590° C. The heated effluent from the tubular heating unit 20 is switched to the other cylindrical reactor 18*b* to undergo a coking reaction under 21 kPa to 172 kPa (3 to 25 p.s.i.g.) pressure and at a temperature of 440° C. to 570° C. When the heavy residue and sludge in cylindrical reactor 18*a* is pumped out to the tubular heating unit 20, fresh waste oil is pumped into the cylindrical reactor 18*a* to be subjected to normal cooling, evaporation, mixing and temperature raising steps. The cylindrical reactor 18*b* is then subjected to the decoking process. After completing the decoking process, the heated effluent from the tubular heating unit 20 is switched to the cylindrical reactor 18*b* and the fresh feedstock supply for the cylindrical reactor 18*a* is stopped. The cylindrical reactor 18*b* is subjected to normal cooling, evaporation, mixing and temperature raising steps. The cylindrical reactor 18*a* is ready for the next coking and decoking processes.

Figure 5:
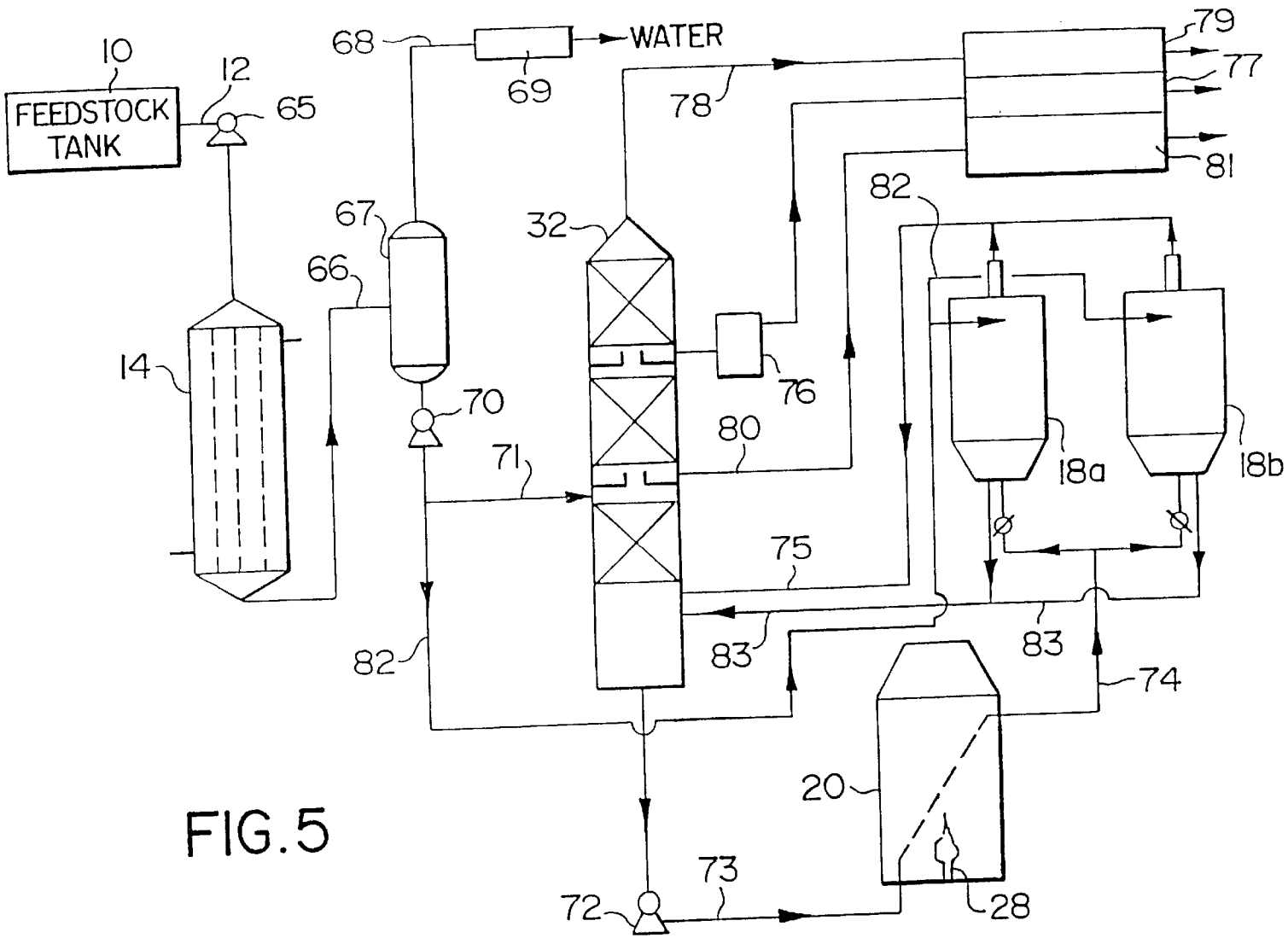
FIG. 5 is a schematic representation of an example of an alternative arrangement for the apparatus of the invention.

As a further alternative, the process may be performed to make most efficient use of the equipment and to recycle and use contained heat for preheating and various process steps. For example, an alternative operation is shown in FIG. 5.

Waste oil feedstock from tank 10 is pumped via pump 65 to heat exchanger 14 to preheat the feedstock to a temperature of about 115° C. with steam. The preheated feedstock is passed via line 66 to a flash drum 67 where water is evaporated from the feedstock and passed via line 68 to a heat exchanger 69 for cooling. The evaporated water is removed. The heated feedstock from flash drum 67 is pumped via pump 70 through line 71 to distillation column 32 for further preheating with the hot vapour stream from cylindrical reactors 18*a* and 18*b*. The heavy oil fraction from the bottom of distillation column 32 is mixed with 3% to 10% steam and is pumped by pump 72 through line 73 to tubular heater 20 where the temperature is raised to 450° C. to 530° C. The heated effluent from tubular reactor 20 is passed via line 74 to the bottom of one of the cylindrical reactors 18*a* or 18*b* for further reaction at 375° C. to 455° C. Vapour fuel from the cylindrical reactor 18*a* or 18*b* is passed via line 75 to the bottom of the distillation column 32 to preheat the feedstock from flash drum 70. The vapour fuel in the distillation column 32 travels upward through the column and is separated into #2 fuel which is removed through stripper 76 which leads to heat exchanger 77, light fuel is passed via line 78 through heat exchanger 79 for cooling and recovery, and some #4 fuel is passed via line 80 through heat exchanger 81 for cooling and recovery.

A portion of the feedstock from the flash drum 70 can be sprayed downwardly via line 82 into the pyrolyzed waste oil mixture held at the bottom of the cylindrical reactor 18*a* or 18*b* to create a mixture of fresh preheated waste oil and the pyrolyzed waste oil mixture for further treatment. The spraying of the waste oil feedstock from the flash drum 70 has the effect of cooling the pyrolyzed waste oil mixture to the desired temperature range of 375° C. to 455° C. The residue in the bottom of the cylindrical reactor 18*a* or 18*b* is mixed via a recycle line 83 with feedstock in the bottom of the distillation column 32 into tubular heater 20. When one of cylindrical reactors 18*a* or 18*b* is filled with coke the heated effluent from tubular reactor 20 is switched to the other reactor to undergo the pyrolysis and coking reaction. The first reactor can then be subjected to a decoking process.

The decoking procedure can be carried out by methods such as steam decoking, water decoking and mechanical decoking.

While the invention has been described in detail above, it will be apparent that various modifications and alterations will be possible without departing from the spirit and scope of the invention.

What is claimed is:

1. A process for treating waste oil containing heavy hydrocarbons and contaminants, which comprises:

heating the waste oil in a reactor to a reactor temperature of 300° C. to 455° C., thereby producing volatile components and a feed mixture comprised of recycled non-volatile residue and the waste oil;

conveying said feed mixture to a heating unit;

raising a temperature of said feed mixture in the heating unit to a range of 400° C. to 490° C. under a pressure of about 40 to 150 p.s.i.g. for a period of time from 1 to 15 seconds, thereby causing pyrolysis of said heavy hydrocarbons contained in the feed mixture, while preventing substantial undesired polymerization, oxidation and dehydrogenation reactions from taking place in said feed mixture;

returning the pyrolyzed feed mixture from the heating unit to the reactor, thereby cooling the resulting pyrolyzed feed mixture to the reactor temperature; maintaining the feed mixture in the reactor at the reactor temperature while allowing volatile components in the pyrolyzed feed mixture to evaporate, leaving a non-volatile residue containing said contaminants;

condensing the evaporated volatile components to form a reclaimed oil product;

mixing the non-volatile residue with fresh waste oil to form more of said feed mixture; and repeating said steps of conveying, raising a temperature, returning, condensing and mixing on a continuous basis, while continuing to condense volatile components evaporated from said pyrolyzed feed mixture.

2. A process according to claim 1, further comprising: raising said feed mixture in the heating unit to a deep cracking temperature to promote deep cracking of said heavy hydrocarbons, when a yield of the reclaimed oil product has fallen to less than 75% of the initial yield.

3. A process according to claim 1, further comprising:

raising said non-volatile residue containing said contaminants in the heating unit to a temperature in the range of 470° C. to 590° C. when contaminants in said pyrolyzed waste oil mixture increase to such an extent that the yield of said reclaimed oil product falls to less that 75% of the initial yield and maintaining said non-volatile residue in the reactor at a temperature of 440° C. to 570° C. under a pressure of 21 kPa to 172 kPa to cause said residue to undergo a further pyrolysis and coking reaction creating further volatile components and a solid coke, whereupon said further volatile components can be removed and condensed, and said solid coke can be collected and discarded.

4. A process according to claim 1 wherein steam is introduced into said feed mixture before said temperature raising step is carried out, and wherein water is separated from said volatile components.

5. A process according to claim 1 wherein the time period is 3 to 10 seconds.

6. A process according to claim 1 wherein the resulting pyrolyzed water oil mixture is cooled to a temperature in the range of 300° C. to 425° C.

7. A process according to claim 1 wherein the resulting pyrolyzed waste oil mixture is cooled to a temperature in the range of 300° C. to 375° C.

* * * * *

UNITED STATES PATENT AND TRADEMARK OFFICE

CERTIFICATE OF CORRECTION

PATENT NO. : 6,132,596
DATED : October 17, 2000
INVENTOR(S) : Yu

It is certified that error appears in the above-identified patent and that said Letters Patent is hereby corrected as shown below:

Column 10,
Line 31, "water" should read -- waste --

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*